US009329008B1

(12) United States Patent
Gilbert et al.

(10) Patent No.: US 9,329,008 B1
(45) Date of Patent: May 3, 2016

(54) LOW COLLATERAL DAMAGE KINETIC ENERGY PROJECTILE

(71) Applicants: Steven Gilbert, Ledgewood, NJ (US); Ahmed Hassan, Summit, NJ (US); Yin Chen, West Milford, NJ (US); Anthony Vella, East Hanover, NJ (US)

(72) Inventors: Steven Gilbert, Ledgewood, NJ (US); Ahmed Hassan, Summit, NJ (US); Yin Chen, West Milford, NJ (US); Anthony Vella, East Hanover, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 102 days.

(21) Appl. No.: 14/444,301

(22) Filed: Jul. 28, 2014

Related U.S. Application Data

(60) Provisional application No. 61/863,547, filed on Aug. 8, 2013.

(51) Int. Cl.
*F42B 12/02* (2006.01)
*F42B 12/74* (2006.01)
*F42B 14/06* (2006.01)

(52) U.S. Cl.
CPC ..... *F42B 12/02* (2013.01); *F42B 12/74* (2013.01); *F42B 14/06* (2013.01)

(58) Field of Classification Search
CPC ..... F42B 10/06; F42B 12/02; F42B 12/06; F42B 12/32; F42B 12/74; F42B 14/06; F42B 14/065; F42B 8/14; F42B 30/08
USPC ..... 102/506, 517, 439, 498, 519, 529
See application file for complete search history.

(56) References Cited

U.S. PATENT DOCUMENTS

| | | | | |
|---|---|---|---|---|
| 2,655,105 | A * | 10/1953 | Hansche | F42B 15/36 102/377 |
| 3,805,702 | A * | 4/1974 | Voss | F42B 5/073 102/439 |
| 4,242,960 | A * | 1/1981 | Boeder | F42B 8/14 102/506 |
| 4,628,821 | A * | 12/1986 | Madderra | F42B 15/36 102/377 |
| 6,895,864 | B2 * | 5/2005 | Ronn | F42B 12/06 102/389 |
| 6,928,931 | B1 * | 8/2005 | Biserød | F15B 15/19 102/253 |
| 8,250,987 | B1 * | 8/2012 | Morley | F42B 10/48 102/438 |
| 8,267,015 | B2 * | 9/2012 | Marx | F42B 10/26 102/501 |

* cited by examiner

*Primary Examiner* — Troy Chambers
*Assistant Examiner* — Bridget Cochran
(74) *Attorney, Agent, or Firm* — Michael C. Sachs

(57) ABSTRACT

A low collateral damage, kinetic energy penetrator has multiple segments that are mechanically locked together by centrifugal force generated by penetrator spin. When the penetrator spin decreases below a minimum value, the segments separate and fall to the ground with non-lethal kinetic energy.

17 Claims, 8 Drawing Sheets

LOW COLLATERAL DAMAGE KINETIC ENERGY PROJECTILE

CROSS-REFERENCE TO RELATED APPLICATIONS

The present application claims the benefit of priority of U.S. provisional patent application Ser. No. 61/863,547 filed on Aug. 8, 2013, which is incorporated by reference herein.

STATEMENT OF GOVERNMENT INTEREST

The inventions described herein may be manufactured, used and licensed by or for the United States Government.

BACKGROUND OF THE INVENTION

The invention relates in general to kinetic energy projectiles and in particular to low collateral damage kinetic energy projectiles.

In modern warfare, a greater emphasis is placed on the reduction of collateral damage to the surrounding infrastructure and to civilian lives. As battles move into urban environments, so do warfighters and their bases. Also, other urban interests may come under attack, such as embassies and consulates. These urban interests need to be protected from incoming threats. The means of intercepting the incoming threats, however, should not destroy the area around these urban interests or unintentionally harm civilians.

Medium caliber (20 mm-60 mm) kinetic energy penetrators are very effective in neutralizing incoming air borne threat munitions such as rockets, artillery, and mortars. These penetrators are typically monolithic cylindrical objects that are made from high density materials to maximize penetration performance. However, the ballistic coefficients of these penetrators can pose a problem in urban environments because the penetrators may possess enough energy to harm bystanders when the penetrators return to the ground. This problem can restrict the use of otherwise effective air defense systems during urban operations.

One possible solution to this problem is the use of self-destructing high explosive munitions, which detonate after a preset flight time. The problem with this class of munitions is that the fuze may not function, thereby creating unexploded ordnance (UXO) and a high probability of collateral damage. Other possible solutions to this problem are disclosed in U.S. Pat. No. 8,250,987 issued to Morley et al. on Aug. 28, 2012; U.S. Pat. No. 8,640,624 issued to Hassan et al. on Feb. 4, 2014; and U.S. Patent Application Publication 2012/0216699 published in the name of Fanucci et al. on Aug. 30, 2012. Fanucci et al. use energetic material to decompose the projectile. Morley et al. rely on an increase in ambient temperature to deform thermally sensitive wire. Hassan et al. rely on aero-drag to decompose the projectile.

A need exists for a low collateral damage kinetic energy projectile that does not use energetic material and that relies on projectile flight to maintain its structural integrity, rather than to break its structural integrity.

SUMMARY OF INVENTION

One aspect of the invention is a kinetic energy penetrator having a central longitudinal axis. The penetrator includes a nose segment having an aft portion and a generally annular middle segment disposed aft of the nose segment. A base segment is disposed aft of the middle segment and includes a forward portion. A compression spring is disposed in the middle segment. The compression spring biases the nose segment and the base segment away from the middle segment.

A pair of torque transfer projections are formed on each of the aft portion of the nose segment and the forward portion of the base segment. The projections in each pair are spaced 180 degrees apart. Slots are formed in an inner surface of the middle segment for receiving the pairs of torque transfer projections. The pairs of torque transfer projections transfer torque from the base segment to the middle segment and the nose segment.

A pair of ball openings are formed in each of the aft portion of the nose segment and the forward portion of the base segment. The ball openings in each pair are offset 90 degrees from respective torque transfer projections. A pair of balls are disposed in each of the two pairs of ball openings. Each ball is translatable in its ball opening. Forward and aft ball detents are formed in the inner surface of the middle segment for receiving the pairs of balls.

Angular velocity of the penetrator causes the two pairs of balls to engage the forward and aft ball detents and mechanically lock the nose segment and the base segment to the middle segment. When the angular velocity decreases sufficiently, the two pairs of balls disengage the forward and aft ball detents thereby enabling the compression spring to separate the nose segment and the base segment from the middle segment.

Each pair of torque transfer projections may be the opposing ends of a pin that is disposed in a through bore formed in each of the aft portion of the nose segment and the forward portion of the base segment.

Each ball may be constrained from translating completely out of its respective ball opening. Each ball opening may be staked to constrain translation of its respective ball.

The forward and the aft ball detents may be grooves that are formed in the inner surface of the middle segment.

Another aspect of the invention is a method that includes providing a penetrator and spinning up the penetrator to a first angular velocity. The method includes translating two pairs of balls into engagement with forward and aft ball detents to thereby mechanically lock together segments of the penetrator.

The method may include decelerating the angular velocity of the penetrator and then translating the two pairs of balls out of engagement with the forward and aft ball detents to thereby unlock the segments of the penetrator.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel, self-destructing, heavy metal kinetic energy penetrator reduces collateral damage and UXO by fragmenting the penetrator without the use of energetic materials. The penetrator includes a plurality of coaxial segments arranged on a central longitudinal axis. The segments may or may not be symmetric about the longitudinal axis. Each segment is sized and shaped to create an individual ballistic coefficient. The individual ballistic coefficient is selected to ensure that aerodynamic drag is sufficient to reduce the segment's terminal energy below the levels designated for lethal injury to ground personnel. For example, each segment will have an energy of less than about 75 joules upon impact with the ground.

Each segment loses its flight stability when separated from the rest of the penetrator. As each segment separates from the parent penetrator, the segment will tumble because of flight instabilities. The flight instability ensures the separated segment will lose a maximum amount of kinetic energy and have minimal terminal effects.

Each segment separates from adjacent segments using an internal mechanical system that unlocks adjacent segments when the penetrator spin rate falls below a predetermined rotational velocity. For example, balls and ball detents are one mechanism that may be used to lock adjacent segments together during penetrator flight. Centrifugal force of the spinning penetrator causes the balls to seat in the ball detents and lock the segments together. When the rotational velocity of the air borne penetrator decreases sufficiently, the balls will move radially inward out of the ball detents and unlock adjacent segments. Another internal mechanism, such as a compressed spring, may be used to push apart and separate the unlocked segments. Once on the ground, the separated segments and internal mechanisms pose no UXO hazard. Also, because no energetic material or fuzes are used, the logistical burden is low and the lifecycle cost is low.

The sub-caliber, segmented penetrator may be encased in a discarding sabot and joined to a cartridge case, in a manner similar to the Mk244 projectile manufactured by General Dynamics. The discarding sabot maintains the discrete segments in an assembled state prior to launching the penetrator. In the launch tube, a driving band on the sabot spins up the penetrator, causing the balls to move into the ball detents and lock the segments together. The sabot is discarded after muzzle exit. If the penetrator has not struck a target by the time its spin rate falls below a minimum value, the balls will dislodge from the ball detents and the compression spring will force the segments apart. The segments will then fall relatively harmlessly to the ground.

Figure 1:
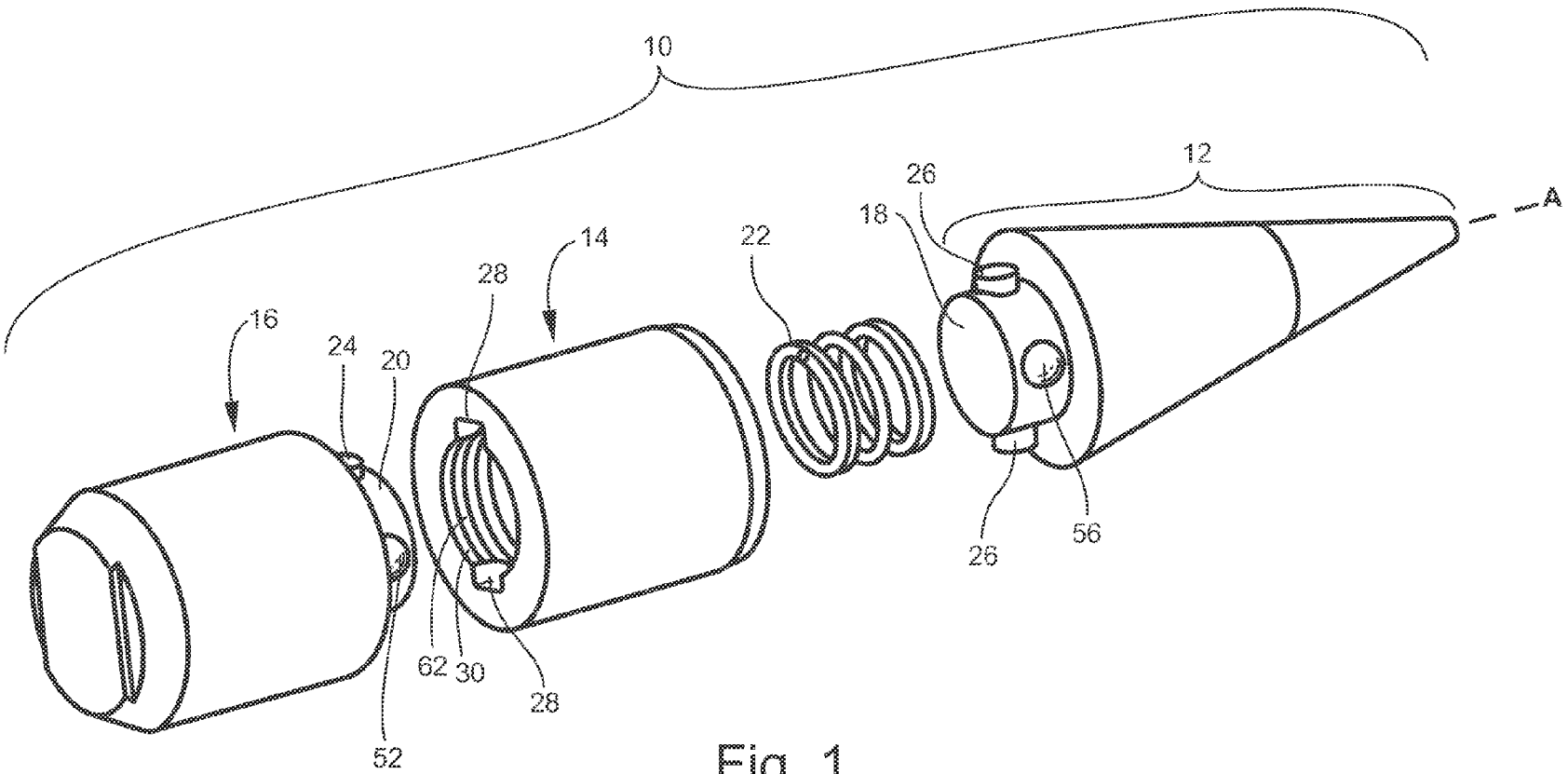
FIG. 1 is an exploded perspective view of one embodiment of a low collateral damage kinetic energy penetrator.

FIG. 1 is an exploded perspective view of one embodiment of a low collateral damage kinetic energy penetrator 10 having a central longitudinal axis A. Penetrator 10 includes a nose segment 12, a middle segment 14 and a base segment 16. Nose segment 12 has an aft portion 18 and base segment 16 has a forward portion 20. Middle segment 14 is generally annular and is disposed aft of the nose segment 12. Base segment 16 is disposed aft of the middle segment 14.

The segments 12, 14, 16 may be made of, for example, a heavy metal such as tungsten. The mass, size and/or shape of segments 12, 14, 16 may be altered to ensure that each segment's kinetic energy at ground impact is less than about 75 joules. For example, asymmetric features may be added to the segments to decrease aerodynamic stability after the segments are separated in flight.

A compression spring 22 is disposed in the middle segment 14. The compression spring 22 contacts the aft portion 18 of nose segment 12 and the forward portion 20 of base segment 16 thereby biasing the nose segment 12 and the base segment 16 away from the middle segment 14.

Figure 2:
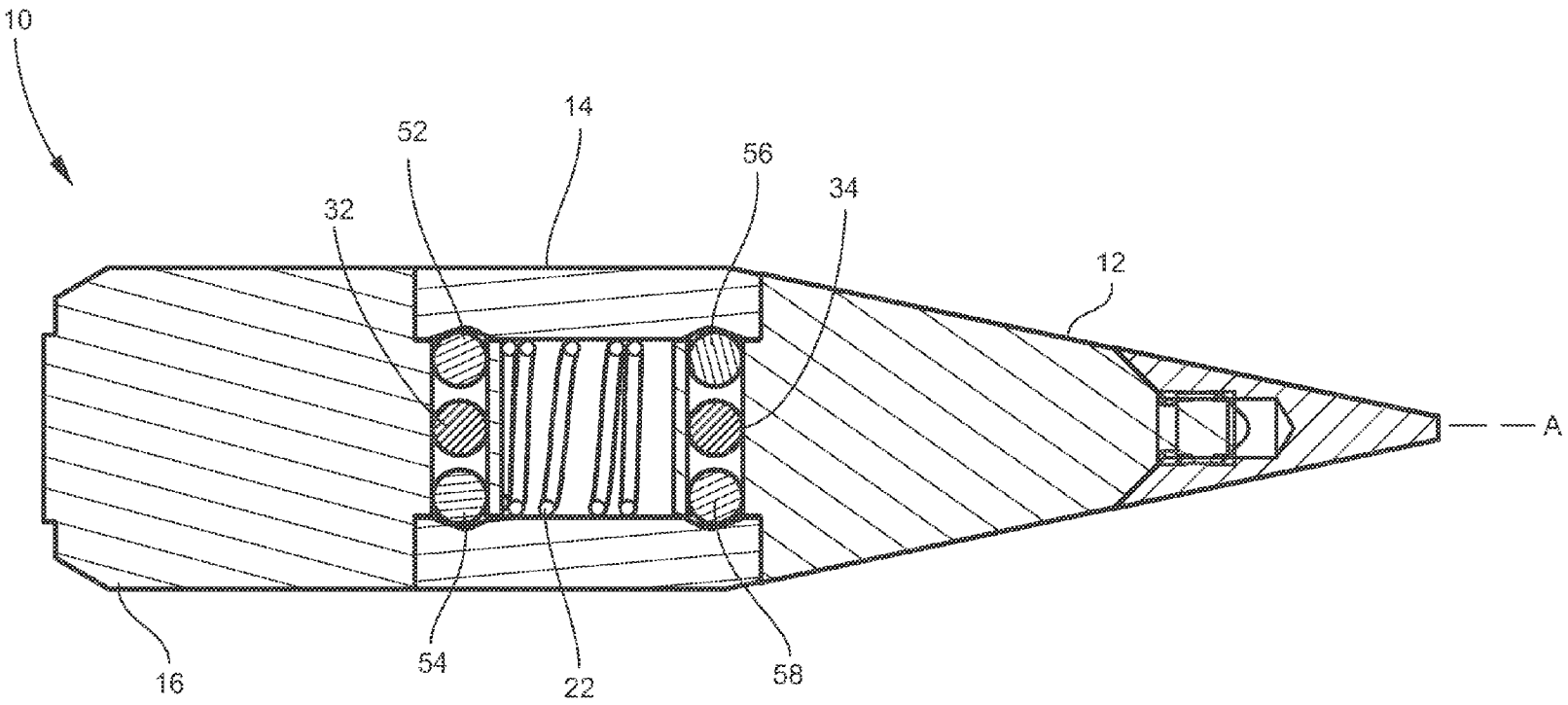
FIG. 2 is a longitudinal sectional view of the penetrator of FIG. 1.
Figure 3A:
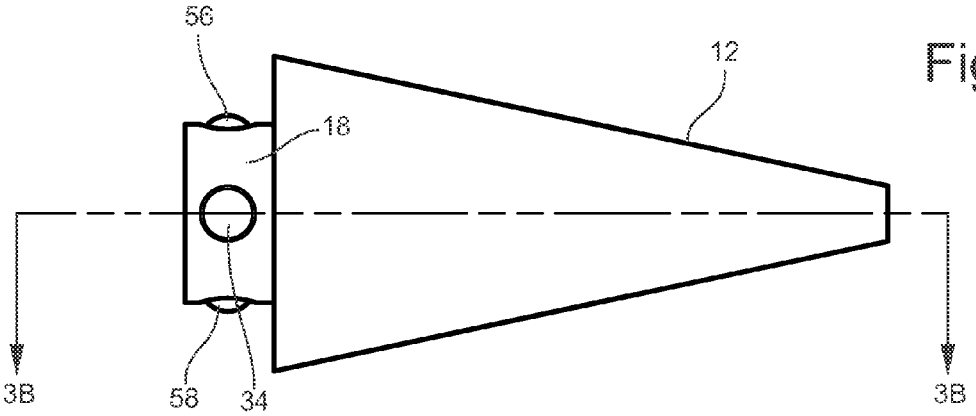
FIG. 3A is a side view of the nose segment of the penetrator.
Figure 3B:
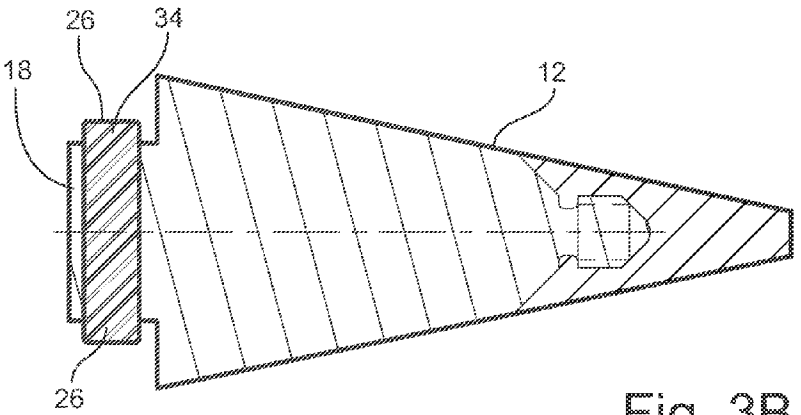
FIG. 3B is a sectional view taken along the line 3B-3B of FIG. 3A.
Figure 3C:
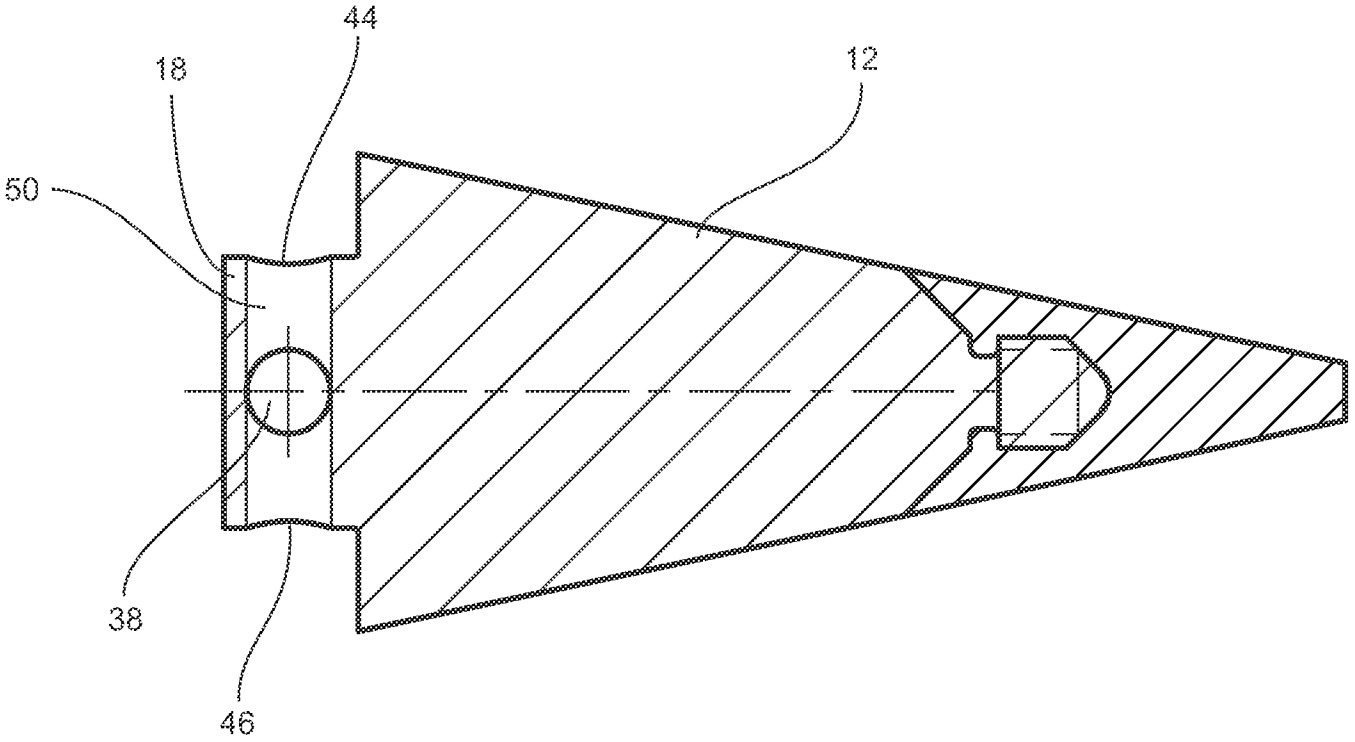
FIG. 3C is a longitudinal sectional view of FIG. 3A with the pin and balls removed.
Figure 4A:
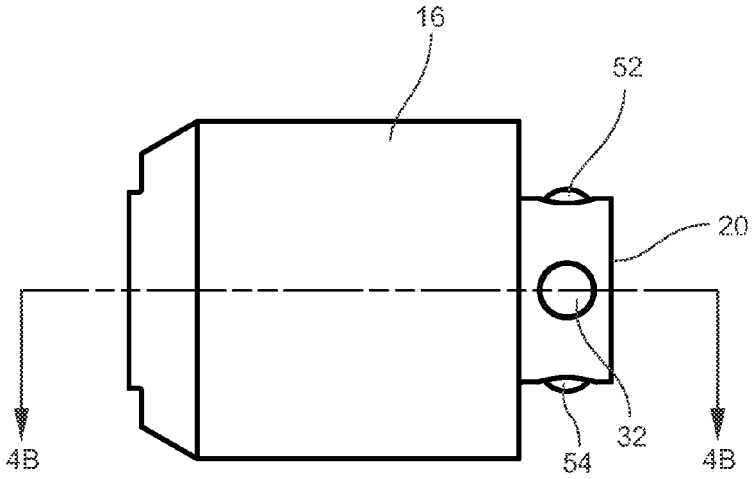
FIG. 4A is a side view of the base segment of the penetrator.
Figure 4B:
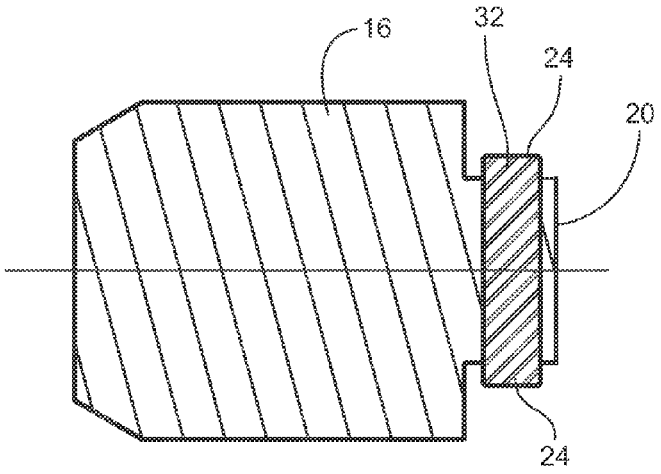
FIG. 4B is a sectional view taken along the line 4B-4B of FIG. 4A
Figure 4C:
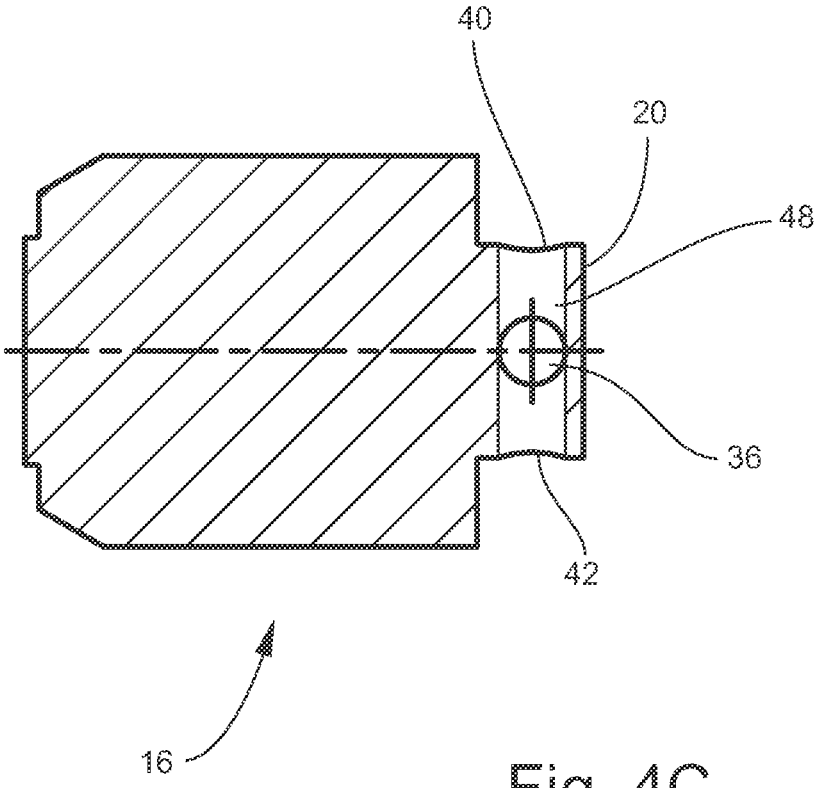
FIG. 4C is a longitudinal sectional view of FIG. 4A with the pin and balls removed.

A pair of torque transfer projections 24, 24 are formed on the forward portion 20 of the base segment 16 and a pair of torque transfer projections 26, 26 are formed on the aft portion 18 of the nose segment 12. Projections 24, 24 are spaced 180 degrees apart and projections 26, 26 are spaced 180 degrees apart. Slots 28 are formed in an inner surface 30 of the middle segment 14 for receiving the pairs of torque transfer projections 24, 24 and 26, 26. The torque transfer projections 24, 24 and 26, 26 transfer torque from the base segment 16 to the middle segment 14 and the nose segment 12. Torque transfer projections 24, 24 may be the opposing ends of a pin 32 (FIGS. 2, 4A, 4B and 6) that is disposed in a through bore 36 (FIG. 4C) formed in the forward portion 20 of the base segment 16. Torque transfer projections 26, 26 may be the opposing ends of a pin 34 (FIGS. 2, 3A. 3B and 6) that is disposed in a through bore 38 (FIG. 3C) formed in the aft portion 18 of the nose segment 12.

A pair of ball openings 40, 42 (FIG. 4C) are formed in the forward portion 20 of the base segment 16 and another of pair of ball openings 44, 46 (FIG. 3C) are formed in the aft portion 18 of the nose segment 12. Ball openings 40, 42 are offset 90 degrees from torque transfer projections 24, 24 and ball openings 44, 46 are offset 90 degrees from torque transfer projections 26, 26. Ball openings 40, 42 may be part of a through bore 48 (FIG. 4C) formed in forward portion 20 of base segment 16. Ball openings 44, 46 may be part of a through bore 50 (FIG. 3C) formed in aft portion 18 of nose segment 12.

A pair of balls 52, 54 (FIGS. 1, 2, 4A and 7) are disposed in respective ball openings 40, 42 (through bore 48) and a pair of balls 56, 58 (FIGS. 1, 2, 3A and 7) are disposed in respective ball openings 44, 46 (through bore 50). Each ball is radially translatable in its respective ball opening or through bore. After insertion of each ball in its respective through bore, the inner wall of the bore is staked to constrain each ball from translating completely out of its respective ball opening. That is, only a portion of each ball can extend radially outward beyond the surface of forward portion 20 of base segment 16 or the surface of aft portion 18 of nose segment 12.

Figure 5C:
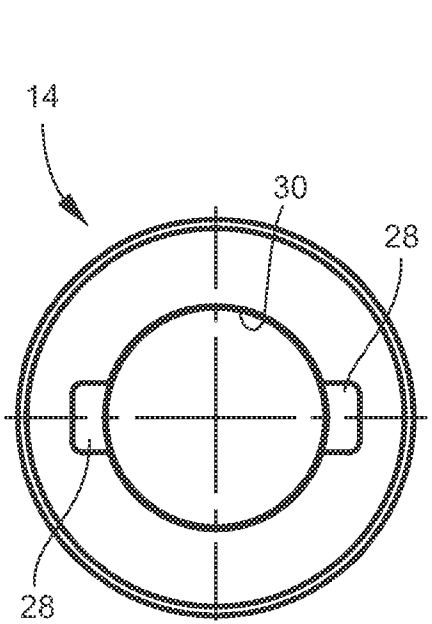
FIG. 5C is a front end view of the middle segment of the penetrator.
Figure 5B:
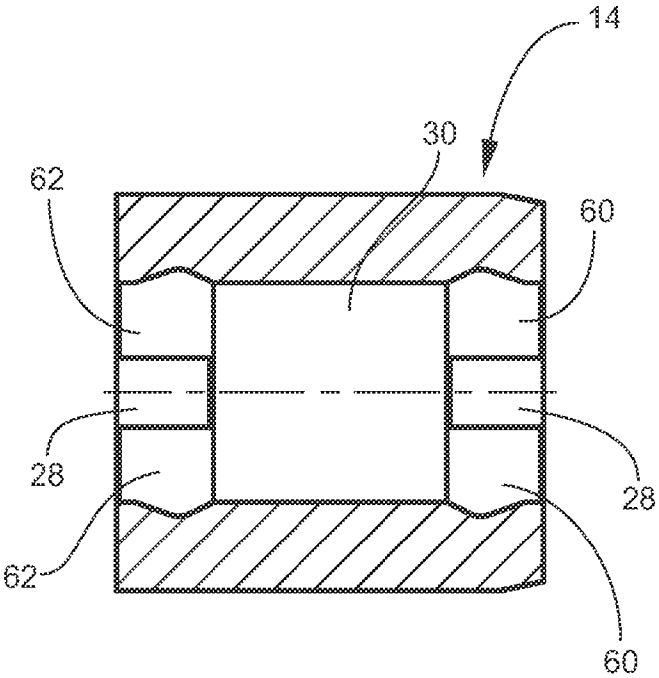
FIG. 5B is a sectional view taken along the line 5B-5B of FIG. 5A.
Figure 5A:
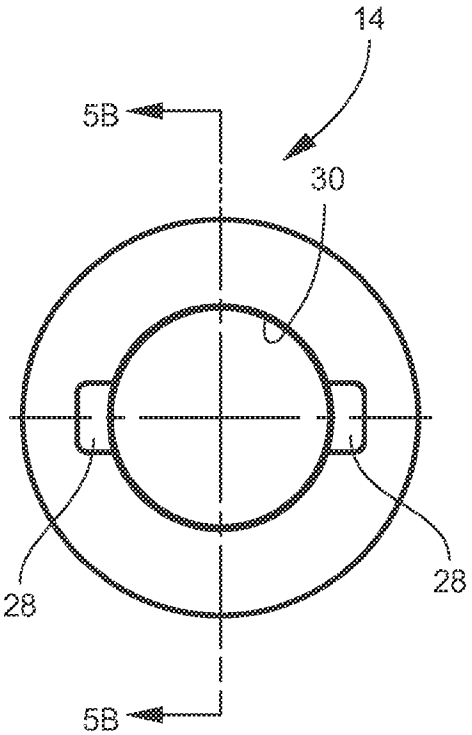
FIG. 5A is an aft end view of the middle segment of the penetrator.
Figure 6:
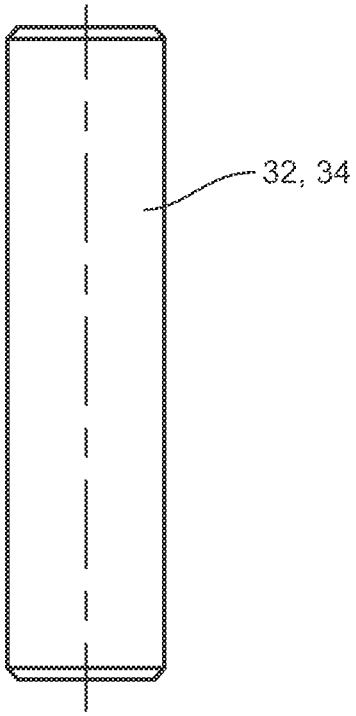
FIG. 6 is a side view of a pin.

Forward and aft ball detents 60, 62 (FIG. 5B) are formed in the inner surface 30 of the middle segment 14 for receiving the pairs of balls. The ball detents 60, 62 may be in the form of grooves. The circumferential extent of the grooves may be interrupted by the slots 28.

Figure 8:
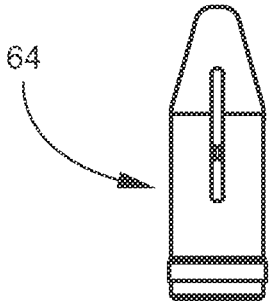
FIG. 8 is a side view of a sabot.
Figure 7:
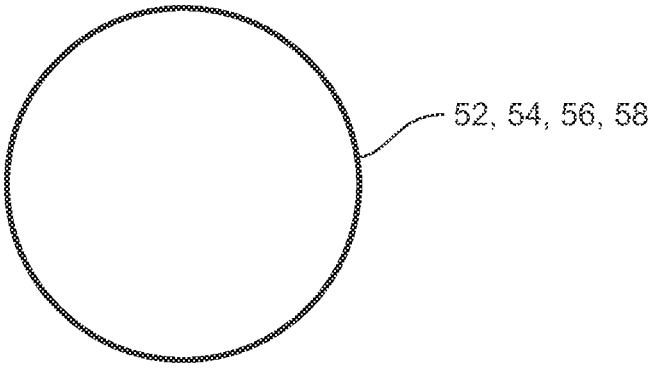
FIG. 7 is a side view of a ball.

A discarding sabot 64 (FIG. 8) may be disposed around penetrator 10 to keep segments 12, 14, 16 together prior to launch. The sabot 64 may include a driving band to spin up the penetrator 10.

When penetrator 10 is launched, it spins up and reaches a sufficient angular velocity whereby centrifugal force causes the two pairs of balls 52, 54 and 56, 58 to move or translate radially outward. The two pairs of balls engage the ball detents 60, 62 in the inner surface 30 of the middle segment 14, thereby mechanically locking the nose segment 12 and base segment 16 to the middle segment 14. After the penetrator 10 exits the launch tube, the sabot 64 is discarded, but the segments 12, 14, 16 remain locked by the engagement of the balls with the ball detents.

If the penetrator 10 does not strike a target, its angular velocity will gradually decrease to a point where the two pairs of balls will disengage (move radially inward away from) the forward and aft ball detents. Then, the compression spring 22 will separate the nose segment 12 and the base segment 16 from the middle segment 14. The separated segments 12, 14, 16 will become aerodynamically unstable and will fall to the ground.

While the invention has been described with reference to certain embodiments, numerous changes, alterations and modifications to the described embodiments are possible without departing from the spirit and scope of the invention as defined in the appended claims, and equivalents thereof.

For example, the penetrator may include more than one middle segment. Further, the halls and torque transfer projections may be located on the middle segment and the slots for the torque transfer projections and the ball detents may be located on each of the nose and base segments.

What is claimed is:

1. A kinetic energy penetrator having a central longitudinal axis, the penetrator comprising:

a nose segment having an aft portion;

a generally annular middle segment disposed aft of the nose segment;

a base segment disposed aft of the middle segment and having a forward portion;

a compression spring disposed in the middle segment, the compression spring biasing the nose segment and the base segment away from the middle segment;

a pair of torque transfer projections formed on each of the aft portion of the nose segment and the forward portion of the base segment, the projections in each pair being spaced 180 degrees apart;

slots formed in an inner surface of the middle segment for receiving the pairs of torque transfer projections whereby the pairs of torque transfer projections transfer torque from the base segment to the middle segment and the nose segment;

a pair of ball openings formed in each of the aft portion of the nose segment and the forward portion of the base segment, the ball openings in each pair being offset 90 degrees from respective torque transfer projections;

a pair of balls disposed in each of the two pairs of ball openings, each ball being translatable in its ball opening; and forward and aft ball detents formed in the inner surface of the middle segment for receiving the pairs of balls;

wherein a first angular velocity of the penetrator causes the two pairs of balls to engage the forward and aft ball detents and mechanically lock the nose segment and the base segment to the middle segment.

2. The penetrator of claim 1, wherein a second angular velocity less than the first angular velocity causes the two pairs of balls to disengage the forward and aft ball detents thereby enabling the compression spring to separate the nose segment and the base segment from the middle segment.

3. The penetrator of claim 2, wherein each pair of torque transfer projections are opposing ends of a pin that is disposed in a through bore formed in each of the aft portion of the nose segment and the forward portion of the base segment.

4. The penetrator of claim 3, wherein each ball is constrained from translating completely out of its respective ball opening.

5. The penetrator of claim 4, wherein each ball opening is staked to constrain translation of its respective ball.

6. The penetrator of claim 4, wherein the forward and the aft ball detents are grooves formed in the inner surface of the middle segment.

7. The penetrator of claim 6, wherein the nose segment, middle segment and base segment comprise tungsten.

8. The penetrator of claim 4, further comprising a discarding sabot disposed around the penetrator.

9. A kinetic energy penetrator having a central longitudinal axis, the penetrator comprising:

a nose segment having an aft portion;

a generally annular middle segment disposed aft of the nose segment;

a base segment disposed aft of the middle segment and having a forward portion;

a compression spring disposed in the middle segment, the compression spring biasing the nose segment and the base segment away from the middle segment;

a pair of torque transfer projections formed on each of the aft portion of the nose segment and the forward portion of the base segment wherein each pair of torque transfer projections are opposing ends of a pin that is disposed in a through bore formed in each of the aft portion of the nose segment and the forward portion of the base segment;

slots formed in an inner surface of the middle segment for receiving the pairs of torque transfer projections whereby the pairs of torque transfer projections transfer torque from the base segment to the middle segment and the nose segment;

a pair of ball openings formed on each of the aft portion of the nose segment and the forward portion of the base segment;

a pair of balls disposed in each of the two pairs of ball openings, each ball being translatable in its respective ball opening and constrained from translating completely out of its respective ball opening; and forward and aft ball detents formed in the inner surface of the middle segment for receiving the pairs of balls, the ball detents comprising grooves.

10. The penetrator of claim 9, wherein a first angular velocity of the penetrator causes the two pairs of balls to engage the forward and aft ball detents and mechanically lock the nose segment and the base segment to the middle segment.

11. The penetrator of claim 10, wherein a second angular velocity less than the first angular velocity causes the two pairs of balls to disengage the forward and aft ball detents thereby enabling the compression spring to separate the nose segment and the base segment from the middle segment.

12. The penetrator of claim 9, wherein each ball opening is staked to constrain translation of its respective ball.

13. The penetrator of claim 9, further comprising a discarding sabot disposed around the penetrator.

14. A method, comprising:

providing the penetrator of claim 1;

spinning the penetrator up to at least the first angular velocity; and translating the two pairs of balls into engagement with the forward and aft ball detents to thereby mechanically lock the nose segment and the base segment to the middle segment.

15. The method of claim 14, further comprising decelerating the angular velocity of the penetrator to less than the first angular velocity and then, translating the two pairs of balls out of engagement with the forward and aft ball detents to thereby unlock the nose segment and the base segment from the middle segment.

16. The method of claim 15, further comprising forcing the nose segment and the base segment away from the middle segment using the compression spring.

17. The method of claim 16, further comprising decreasing the kinetic energy of each of the nose segment, middle segment and base segment to less than about 75 joules.

* * * * *